US007156902B1

(12) United States Patent
Altman

(10) Patent No.: US 7,156,902 B1
(45) Date of Patent: Jan. 2, 2007

(54) WET ELECTRO-CORE GAS PARTICULATE SEPARATOR

(75) Inventor: Ralph F. Altman, Chattanooga, TN (US)

(73) Assignee: Electric Power Research Institute, Palo Alto, CA (US)

( * ) Notice: Subject to any disclaimer, the term of this patent is extended or adjusted under 35 U.S.C. 154(b) by 0 days.

(21) Appl. No.: 11/121,371

(22) Filed: May 4, 2005

(51) Int. Cl.
*B03C 3/013* (2006.01)
*B03C 3/014* (2006.01)

(52) U.S. Cl. ..... 96/53; 95/65; 95/71; 95/78; 96/61; 96/96

(58) Field of Classification Search ..... 95/64, 95/65, 71, 72, 78; 96/52, 53, 61, 96
See application file for complete search history.

(56) References Cited

U.S. PATENT DOCUMENTS

| | | | | |
|---|---|---|---|---|
| 1,381,719 | A * | 6/1921 | McGee et al. | 95/69 |
| 4,208,192 | A * | 6/1980 | Quigley et al. | 95/2 |
| 5,591,253 | A | 1/1997 | Altman et al. | 96/61 |
| 5,683,494 | A | 11/1997 | Altman et al. | 96/55 |
| 5,914,454 | A * | 6/1999 | Imbaro et al. | 95/64 |
| 5,961,693 | A | 10/1999 | Altman et al. | 95/78 |
| 5,968,231 | A * | 10/1999 | Parmentier et al. | 95/28 |
| 6,017,381 | A * | 1/2000 | Dunn et al. | 95/3 |
| 6,096,118 | A | 8/2000 | Altman et al. | 96/50 |
| 6,228,148 | B1 * | 5/2001 | Aaltonen et al. | 95/74 |
| 6,964,698 | B1 * | 11/2005 | Davis et al. | 96/52 |
| 2002/0017194 | A1 * | 2/2002 | Stivers | 96/61 |

FOREIGN PATENT DOCUMENTS

| | | | | |
|---|---|---|---|---|
| JP | 55-86516 | * | 6/1980 | 96/61 |

* cited by examiner

*Primary Examiner*—Richard L. Chiesa
(74) *Attorney, Agent, or Firm*—Armstrong, Kratz, Quintos, Hanson & Brooks, LLP

(57) ABSTRACT

A gas separation apparatus combines the technologies of electrostatic precipitators and centrifugal particle separators into a single unit. At an inlet into the gas separation apparatus, a water spray is introduced into the gas stream. The water spray may include various chemical additives, typically selected to react with or neutralize the particulates as they are mixed with the water or for other benefit. The resulting water and particulate mixture, which is much more dense than air, is centrifugally separated and collected through a drain tube outlet. In addition to the centrifugal forces applied to the gas and water stream, an electrical field of magnitude sufficient to produce coronal discharge is also applied to a central electrode. The electric field is generated between the cylinder wall and the central electrode, to assist the centrifugal forces and thereby remove additional particulate beyond that ordinarily removed by a standard centrifugal separator. A vortex finder surrounds the central electrode and protects the electrode from undesirable exposure to water splashes or the like, while assisting with the centrifugal separation. The novel separation apparatus and technique offer particular synergy when applied to the effluent stream from a fossil-fuel electric power plant or other similar gas streams.

9 Claims, 1 Drawing Sheet

WET ELECTRO-CORE GAS PARTICULATE SEPARATOR

BACKGROUND OF THE INVENTION

1. Field of the Invention

This invention pertains generally to gas separation apparatus, and more specifically, to the combination of wet centrifugal separation with electrostatic precipitation for the removal of fine particulate and gas contaminants from an air stream in a compact and essentially continuous process.

2. Description of the Related Art

Industries as diverse as mills, pharmaceutical, chemical, and food processing factories, and cement kilns must all separate contaminants or particulates from an air or gaseous stream. The gases may be a product of combustion, such as present in an exhaust stack, but may also represent other gas streams and may contain such diverse materials as liquid particulates, smoke or dust from various sources, and the like. Separators that must process relatively large volumes of gas are common in power generating facilities and factories.

The techniques used for purification of gas streams have been diverse, including such techniques as filtration, washing, flocculation, centrifugation, and electrostatic precipitation. Each technique has heretofore been associated with certain advantages and disadvantages. These features and limitations have dictated application.

In filtration, particulates are separated through a mechanical filter which selectively traps particles of a minimum size and larger. Unfortunately, flow through a filter is limited by the surface area and cleanliness of the filter, and the size of the openings in the filter. The filter material must be both durable and simultaneously open and porous. In higher volume systems, in corrosive or extreme environments, and in environments with large quantities of fine particulate, filters tend to clog quickly and unpredictably, and present undesirable resistance to the passage of the gas stream. During the period of filter changing or cleaning, which can be particularly tedious, the machine, equipment, or process must be stopped or diverted. This shut-down requires either a duplicate filtration pathway, which may add substantial cost and space requirements, or a shut-down of the machine or process. The limitations present design challenges that have primarily limited this technology to low volume purification.

Washing offers an advantage over dry filtration in presenting the opportunity for selective gas or liquid particulate separation and neutralization, and in reduced gas flow resistance. Unfortunately, the liquid must also be processed, and where there are high levels of particulates, the particulates must be separated from the liquid by yet another process, or the liquid and particulates must be transported to some further industrial or commercial process or disposal location.

Similar to washing, flocculation necessitates the introduction of additional materials that add bulk to the waste stream and unnecessarily complicate the handling and disposal of the contaminants. Furthermore, the flocculating materials must also be provided as raw materials, which may add substantial expense in the operation of such a device, Consequently, flocculation is normally reserved for systems and operations where other techniques have been unsuccessful, or where a particular material is to be removed from the gas stream which is susceptible to specific flocculent that may provide other benefit.

Centrifugation presents opportunity for larger particle removal, such as separation or sand or grit from an air stream. However, centrifugation becomes slower and more complex as the size of the entrained particles or liquids become smaller. Consequently, in applications such as the removal of fly ash from a combustion stream, centrifugation tends to be selective only to relatively large particles, thereby leaving an undesirably large quantity of fine fly-ash in the effluent stream. Furthermore, with larger deviations in particle size, design for adequate separation is more difficult.

Electrostatic precipitators have demonstrated exceptional benefit for contaminants including fly ash, while avoiding the limitations of other processes. For example, unlike centrifugation and filtration, electrostatic precipitators tend to be highly effective at removing particulates of very minute size from a gas stream. The process provides little if any flow restriction, and yet substantial quantifies of contaminants may be removed from the air stream.

When contaminants pass through an electrostatic precipitator, they first pass near precipitator electrodes, which transfer an electrostatic charge to the contaminants. Once charged, the contaminants will be directed by the charge force towards oppositely charged collecting electrodes. The collecting electrodes are frequently in the form of plates having large surface area and relatively small gap between collector plates. The dimensions of the plates and the inter-electrode spacing is a function of the composition of the gas stream electrode potential particulate size of contaminants, anticipated gas breakdown potential, and similar known factors. The selection of dimension and voltage will be made with the goal of gas stream purification in mind, and in gas streams where very fine particulate matter is to be removed, such as with fly ask relatively high voltage potentials and larger plates may be provided. The proper transfer of charge to the particulates and the subsequent electrostatic attraction to collector plates is vital for proper operation. As may be recognized, contaminant cases may not be separated using electrostatic precipitation.

In electrostatic precipitators the collector plates accumulate particulate contaminants. This is by design. As electrically non-conductive particles are deposited, the layers of accumulating particles develop a charge potential gradient through the thickness of the deposited layer, whereby the voltage at the exposed surface decreases in electrical potential, and possibly even reverses charge. When a sufficiently thick layer of electrically non-conductive particles have accumulated to reduce the surface potential, further significant particulate capture becomes difficult or impossible. Disadvantageously then, the conventional plate-type electrostatic separators have certain drawbacks, which include collection efficiency reduction due to high or low resistivity dust accumulation, re-entrainment due to mixing of gas and broken dust layer, leakage of untreated dust from sides of the electrodes, and sweepage due to leakage from below the electrodes over collection hoppers. When the dust resistivity is great enough, the potential gradient through the dust layer formed on the collecting electrodes may locally exceed the layer's breakdown potential. This causes a phenomenon known as "back-corona", "back-discharge", "back-ionization", or "reverse-ionization", which results in re-entrainment of collected particles in the clean stream. On the other hand, when the resistivity of the dust is low, there is little force to hold it on the collecting electrodes. Not only is the dust held insecurely, but it packs together loosely so that its cohesiveness is also low. Therefore, the dust can be removed from the electrodes by small vibrations or even variations in gas velocities.

Rapping, which is mechanical agitation designed to remove dust from electrodes, leads to a certain amount of re-entrainment into the gas stream. Rapping re-entrainment in severe cases can account for more than 90% of the outlet dust burden. When rapped, poorly cohesive dust tends to break into a cloud of small clumps instead of falling neatly into the hopper as a coherent sheet. As a consequence, much of the dust returns to the gas flow and, unless it is intercepted, will escape from the precipitator outlet, thereby lowering collection efficiency. Consequently, and in spite of the many benefits, electrostatic precipitators have heretofore required a large number of sections that are electrically and mechanically independently operated in a series arrangement to reduce rapping and reintrainment losses to acceptable levels. The present inventor has previously proposed the combination of centrifugation and electrostatic precipitation, in what has heretofore been referred to as an Electro-Core. Several patents illustrate the Electro-Core that are assigned to the present assignee, including U.S. Pat. Nos. 5,591,253; 5,683,494; 5,961,693 and 6,096,118; each which are incorporated herein by reference for their teachings of combined centrifugation and electrostatic precipitation. In these patents, an inlet stream is both centrifuged and electrostatically separated, and a continuous effluent stream provides for the continuous removal of a concentrated stream of contaminant, to reduce or eliminate the need to shut down the process for particulate removal. The resulting separator has the added benefits of reduced size and cost, but provides no particulate collection.

Unfortunately, using the combination of centrifugation and electrostatic separation, there still remains a need for improved removal of particulate, and additional desire to remove contaminant gases, which are presently unremovable using either centrifugation or electrostatic precipitation. What is desired then is a method or apparatus to overcome these limitations of the present Electro-Core precipitators.

SUMMARY OF THE INVENTION

The present invention overcomes the limitations of the prior art by introducing a water spray into an Electro-Core precipitator, and removing particulate effluent through a water discharge at the bottom of the precipitator. By using selected designs for the vortex finder, splash or particle re-entrainment are reduced, while selective gas separation is enabled. Both are desirable for many applications. The invention may be described as both a novel configuration and a novel operational method.

In a first manifestation, the invention is an apparatus for separating particles from a gas stream. A separation chamber has a cylindrical wall bound at opposing ends. An inlet passage for admitting a gas stream having particulates entrained therein into the separation chamber comprises a thin elongated slit opening tangentially to the cylindrical wall of the separation chamber. This inlet passage provides a substantially flush incoming flow path dispersed lengthwise along the separation chamber wall, thereby maintaining laminar, non-turbulent flow. A sprayer within the inlet passage operatively introduces liquid droplets into the inlet gas stream. An outlet drain expels an effluent liquid that contains dissolved gases along with particles disentrained from said gas stream. At least one vortex finder is suspended centrally within the separation vessel between the ends thereof and establishes an end-to-end outgoing clean flow path through the separation vessel and out from at least one end thereof. An elongated discharge electrode is suspended centrally within the separation vessel between the ends thereof, and a power supply is connected between the cylindrical wall of the separation chamber and the discharge electrode for establishing an electric potential therebetween which serves to charge and electrostatically force entrained particles toward the cylindrical wall of the separation chamber. A gas stream flowing into the inlet passage, through the separation chamber, and out the outgoing clean flow path creates a vortex in the separation chamber which imparts a centrifugal force on the entrained particles toward the wall of the separation chamber, and the centrifugal force is augmented by electrostatic force to propel particles away from the vortex finder.

In a second manifestation, the invention is a walled separation vessel having a length and respective ends and further having a substantially cylindrical separation chamber formed therein defined by a wall and having an effluent drain. An inlet passage means is formed in the separation vessel along the length thereof and communicates with the separation chamber. The inlet passage means is shaped as a narrow slit extending the length of the separation vessel, such that a particulate-laden gas stream is received through the inlet passage means into the separation chamber tangentially to the wall. A means is provided for generating liquid droplets within the particulate-laden gas, and a permeable core separator is mounted within the separation vessel substantially concentrically of the separation chamber. Means are provided for directing a clean gas stream axially through the separation vessel and through the permeable core separator therein from one end of the separation vessel through the other end, creating a vortex in the separation chamber which imparts a centrifugal force on the particles towards the wall of the separation vessel. Means are additionally provided for pre-charging the particles in the gas stream at a given polarity, and means are provided for establishing an electrostatic field between the permeable core separator and the wall of said separation vessel. The permeable core separator is charged at the same polarity as the charge imparted on the particles, thereby repelling the particles from the permeable core separator and instead propelling them towards the wall of the separation vessel, thereby augmenting the centrifugal force to propel particles against the wall and outwardly through the effluent drain.

In a third manifestation, the invention is a method for purifying a gas stream. According to the method, a mist of droplets is generated within the gas stream. A corona discharge is then applied to the misted gas stream to produce an electrical charge therein. The gas stream is centrifuged while in the presence of an electric field to produce a purified gas stream and an effluent formed from particles within said gas stream, and the effluent is collected.

In accord with the present invention, various additives may be incorporated into the mist, and the teachings applied to the separation and collection of gases and particulates entrained in a gas stream.

OBJECTS OF THE INVENTION

A first object of the invention is to improve the operational effectiveness of gas separation systems. A second object of the invention is to reduce or eliminate down time required for cleaning or removing filtrate. A third object of the invention is to enhance existing cleaning techniques with a complementary and non-exclusive technique to obtain the benefits of both. Another object of the invention is to eliminate the need for a second effluent gas stream and also prevent the induction of water droplets into the clean flow stream. A further object of the invention is to protect high voltage electrostatic components from contact with or splashes of water. Yet another object of the invention is to facilitate better collection of effluent from fossil fueled electric utility plants. These and other objects are achieved in the present invention, which may be best understood by the following detailed description and drawing of the preferred embodiment.

DESCRIPTION OF THE PREFERRED EMBODIMENT

Figure 1:
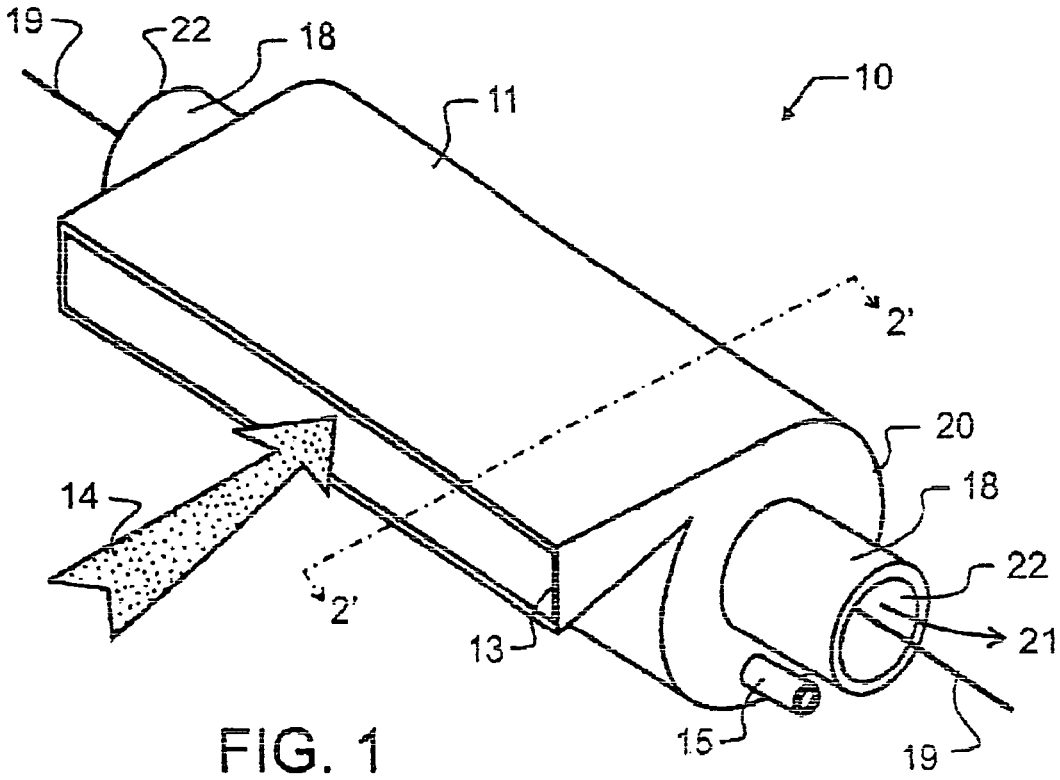
FIG. 1 illustrates a preferred gas separation apparatus designed in accord with the teachings of the invention by projected view.
Figure 2:
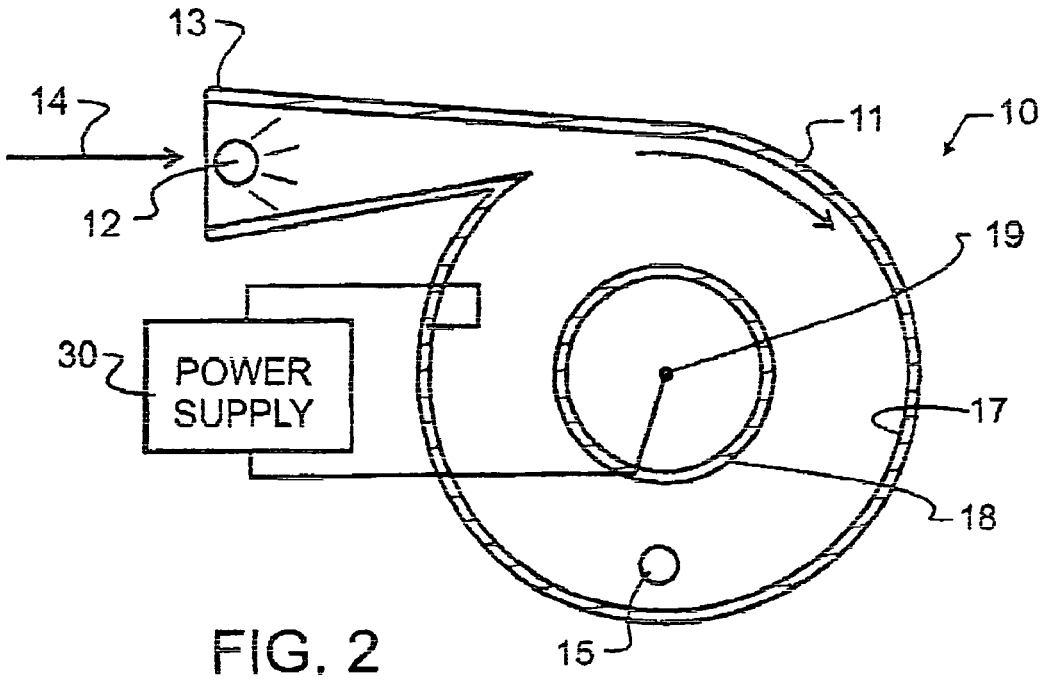
FIG. 2 illustrates the preferred apparatus of FIG. 1 from a cross-sectional view taken along line 2' of FIG. 1.

As illustrated in FIGS. 1 and 2, wet electro-core 10 includes a cylindrical separation vessel 11 having a triangular prism-shaped inlet passage 13 for admitting gas stream 14. While a number of other shapes besides the preferred triangular prism may be conceived for inlet passage 13, several desirable conditions should be met by the design. First, a means for introducing a mist or spray into gas stream 14, such as spray tube 12 illustrated in FIG. 2, will be provided. Most preferably, the induction of water droplets into gas stream 14 will be accomplished to minimize the separation of water from gas stream 14 and to prevent dripping or undesirable run-off from spray tube 12 within inlet passage 13. Where this dripping is not preventable, or as a preventative measure, drain means may be provided, and may, for exemplary purposes, couple into drain tube 15 described herein below. Most preferably, the droplets of water will be thoroughly admixed into gas stream 14 to provide a maximum surface contact with gases and particulates entrained therein, and will remain as droplets and not be evaporated during the subsequent travel within separation vessel 11. Finally, gas stream 14 will most preferably exit inlet 13 without inappropriate movement, such as counterproductive turbulence or the like which might otherwise interfere with the centrifugal separation intended within separation vessel 11.

Inlet passage 13 is in fluid communication with separation vessel 11 and maintains a tangential fluid flow with respect to the walls 17 of the separation chamber 11. Inlet passage 13 is formed as a narrow cross-section of the total diameter of separation vessel 11 to distribute the fluid flow along cylindrical wall 17 of the separation vessel 11. This insures that all particulates enter separator vessel 11 proximate to walls 17 thereof. Such proximity greatly improves separation efficiency because turbulent diffusion processes which might otherwise cause particulate re-entrainment are less intensive in the region adjacent to separator walls 17. Wet electro-core 10 further includes at least one vortex finder 18 which may, for exemplary purposes, be formed as one or more cylindrical tubes, or, alternatively as louvers, both which are illustrated in my prior U.S. Pat. No. 5,591,253 incorporated by reference herein above. Other suitable geometries which may also provide suitable function are understood to be incorporated herein.

Mechanical separation, which is a result of centrifugal forces acting upon gas stream 14, is electrostatically enhanced using discharge electrode 19, which extends centrally throughout vortex finder 18. A power supply 30 is connected between walls 17 and discharge electrode 19 for establishing an electric potential therebetween. The voltage will be of sufficient magnitude to drive discharge electrode 19 into coronal discharge. The electric charge is thereby transferred from discharge electrode 19 to the particles, which are then attracted by electrical forces of attraction and repulsion, to wall 17. This way, the electrostatic field repels the particles from discharge electrode 19. Consequently, electrostatic forces help to prevent the entry of particulate into the separator core. At the same time, sanitized gas 21 is free to flow outward through the clean gas outlets 22. While in the preferred embodiment illustrated, the corona discharge is provided by discharge electrode 19, it is further contemplated herein that corona wires may be provided in advance of separation vessel 11, such as within inlet 13.

Gas stream 14 enters inlet passage 13, is mixed with droplets from tube 12, and is introduced tangentially into separator vessel 11. This creates a vortex inside separation vessel 11. As particles are swirled the separation vessel 11, the inertia of the particles, which may include droplets and particles or gases absorbed or dissolved within the droplets and fine particulate, will propel the particles outward toward wall 17. Contaminants such as sulphur dioxide, hydrochloric acid and oxidized mercury found in fossil fueled electric generating effluent streams are difficult or impossible to separate using the prior art electro-core technology or electrostatic precipitation. By introducing the water spray and during the subsequent mixing which necessarily occurs, some of these contaminants will be absorbed or dissolved into the water droplets. The droplets, now containing these contaminants, will eventually be expelled from separator 10 through outlet drain tube 15.

The washing of the gas stream by water droplets, followed by centrifugal separation enhanced by electrostatic forces, results in a very pure clean gas stream 21 flowing from the clean gas outlets 22. Particulate separation processes are accomplished proximate separator walls 17, where turbulent diffusion processes are less intensive than in the core region, which predetermines very high separation efficiencies. Corona suppression is also reduced, due to very low particulate concentration in the central region of separation vessel 11.

By introducing a sufficient amount of moisture into gas stream 14 through tube 12, wall 17 additionally acts as a collection surface, where droplets are collected to form a liquid flow of particulate and dissolved gases. This collection of particulate matter is different from prior art electro-core function, wherein in the prior art a single gas stream was separated into a relatively clean and a relatively dirty gas stream. In the present invention, wet electro-core 10 serves also as a collector, and thereby does not require the additional contaminated gas stream exit port. Through the beneficial action of centrifugal separation subsequent to the introduction of water droplets, clean gas stream 21 exits without water droplets entrained therein, resolving a problem of the prior art wet electrostatic precipitators.

While not restricted thereto, it is contemplated herein that other techniques may be used to modify or further enhance the separation process, including but riot limited to the use of temperature modification of wall 17 to encourage condensation, use of temperature or pressure variation to induce condensation within the gas stream at inlet 13 to produce the desired droplets rather than spraying additional water therein, the addition of various ingredients into the water stream introduced at tube 12 such as various reactive and neutralizing agents, and also various compounds that may enhance the absorption, adsorption or dissolution of components within the gas stream into water droplets. Other ingredients which may be suited for an application, such as corrosion inhibitors, foaming or anti-foaming ingredients, anti-scaling compounds, and other such additives are also contemplated herein. Additionally, a sorbent such as activated carbon may further be provided, in the present case preferably prior to when gas stream 14 is exposed to spray tube 12. Such an addition will further enhance mercury capture.

Separation vessel 11 is illustrated in the preferred embodiment as having a generally cylindrical configuration. The configuration provides a large and unimpeded inlet adjacent wall 17, which is therefore most preferred and finds particular utility in large air-flow environments such as are associated with electric power generating facilities and the like. The physical orientation of separation vessel 11 will most preferably accommodate draining of collected liquids through outlet drain tube 15. Other features that may assist therewith, including drain troughs, active or passive features to collect the water, and the like are contemplated herein. Additionally, the vortex finder 18 and discharge electrode 19 may have shapes which differ from the illustrated wire surrounded by coaxial cylinder. For instance, known discharge electrode configurations such as rods may be used, as may scalloped bars, rods with spaced disks, barbed wires, tubes with perforated surfaces, etc.

The preferred wet electro-core 10 may find application as a primary separator, or may alternatively be used in association with other gas separation equipment, either before or subsequent thereto as a polishing device.

Having thus disclosed the preferred embodiment and some alternatives to the preferred embodiment, additional possibilities and applications will become apparent to those skilled in the art without undue effort or experimentation. Therefore, while the foregoing details what is felt to be the preferred embodiment of the invention, no material limitations to the scope of the claimed invention are intended. Further, features and design alternatives that would be obvious to one of ordinary skill in the art are considered to be incorporated herein. Consequently, rather than being limited strictly to the features recited with regard to the preferred embodiment, the scope of the invention is set forth and particularly described in the claims herein below.

I claim:

1. An apparatus for separating particles from a gas stream comprising:

a separation chamber having a cylindrical wall bound at opposing ends;

an inlet passage for admitting a gas stream having particulates entrained therein into said separation chamber comprising a thin elongated slit opening tangentially to said cylindrical wall of said separation chamber and providing a substantially flush incoming flow path dispersed lengthwise along said wall;

a sprayer within said inlet passage operatively introducing liquid droplets into said inlet gas stream;

an outlet drain for expelling from said separation chamber a liquid containing dissolved gases and particles disentrained from said gas stream;

at least one vortex finder suspended centrally within the separation vessel between the ends thereof and establishing an end-to-end outgoing clean flow path through the separation vessel and out from at least one end thereof;

an elongated discharge electrode suspended centrally within said separation vessel between said ends thereof; and a power supply connected between said cylindrical wall of said separation chamber and said discharge electrode for establishing an electric potential therebetween which serves to charge and electrostatically force said entrained particles in said separation vessel toward said cylindrical wall of said separation chamber, wherein a gas stream flowing into said inlet passage, through said separation chamber, and out said outgoing clean flow path creates a vortex in said separation chamber which imparts a centrifugal force on said entrained particles toward the wall of said separation chamber, and said centrifugal force is augmented by said electrostatic force to propel said particles away from said at least one vortex finder.

2. The apparatus for separating particles from a gas stream according to claim 1, wherein said vortex finder comprises a cylindrical arrangement of louvers.

3. The apparatus for separating particles from a gas stream according to claim 1, wherein said liquid droplets comprise water.

4. The apparatus for separating particles from a gas stream according to claim 3, wherein said liquid droplets further comprise chemicals reactive with constituents of said gas stream.

5. The apparatus for separating particles from a gas stream according to claim 3, wherein said liquid droplets further comprise chemicals which enhance interaction between said water and said gas stream.

6. An apparatus for separating particles from a gas stream, comprising:

a walled separation vessel having a length and respective ends and further having a substantially cylindrical separation chamber formed therein defined by a wall and having an effluent drain communicating from said wall within cylindrical separation chamber to an exterior thereof;

inlet passage means formed in said separation vessel along the length thereof and communicating with the separation chamber therein, said inlet passage means being shaped as a narrow slit extending said length of said separation vessel, such that a particulate-laden gas stream is received through said inlet passage means into said separation chamber tangentially to said wall thereof;

means for generating liquid droplets within said particulate-laden gas;

a permeable core separator mounted within said separation vessel substantially concentrically of said separation chamber therein;

means for directing a clean gas stream axially through said separation vessel and through said permeable core separator therein from one end of said separation vessel and through the other end thereof, thereby creating a vortex in said separation chamber which imparts a centrifugal force on said particles towards said wall of said separation vessel;

means for pre-charging particles in said particulate-laden gas stream at a given polarity; and means for establishing an electrostatic field between said permeable core separator and said wall of said separation vessel, said permeable core separator charged at the same polarity as the charge imparted on said particles, thereby repelling said particles from entering into said permeable core separator and propelling said particles towards said wall of said separation vessel, and thereby augmenting the centrifugal force to propel particles against said wall and outwardly through said effluent drain.

7. The apparatus for separating particles from a gas stream according to claim 6, wherein said liquid droplets comprise water.

8. The apparatus for separating particles from a gas stream according to claim 7, wherein said liquid droplets further comprise chemicals reactive with constituents of said gas stream.

9. The apparatus for separating particles from a gas stream according to claim 7, wherein said liquid droplets further comprise chemicals which enhance interaction between said water and said gas stream.

* * * * *